US008109116B2

(12) United States Patent
Sekiya et al.

(10) Patent No.: US 8,109,116 B2
(45) Date of Patent: Feb. 7, 2012

(54) DUAL COMPRESSOR AIR CONDITIONING SYSTEM WITH OIL LEVEL REGULATION

(75) Inventors: Shin Sekiya, Tokyo (JP); Masayuki Kakuda, Tokyo (JP); Toshihide Koda, Tokyo (JP); Masahiro Sugihara, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 504 days.

(21) Appl. No.: 11/912,903

(22) PCT Filed: May 24, 2006

(86) PCT No.: PCT/JP2006/310326

§ 371 (c)(1),
(2), (4) Date: Oct. 29, 2007

(87) PCT Pub. No.: WO2007/023599

PCT Pub. Date: Mar. 1, 2007

(65) Prior Publication Data

US 2009/0064709 A1 Mar. 12, 2009

(30) Foreign Application Priority Data

Aug. 26, 2005 (JP) ..... 2005-245892

(51) Int. Cl.

| | |
|---|---|
| ***F25B 43/02*** | (2006.01) |
| ***F25B 1/00*** | (2006.01) |
| ***F25B 1/10*** | (2006.01) |
| ***F25B 9/00*** | (2006.01) |
| ***F25B 31/00*** | (2006.01) |

(52) U.S. Cl. ..... 62/468; 62/84; 62/87; 62/192; 62/193; 62/401; 62/402; 62/498; 62/510

(58) Field of Classification Search ..... 418/87; 62/84, 225, 468, 510, 87, 192, 193, 498, 62/401, 402

See application file for complete search history.

(56) References Cited

U.S. PATENT DOCUMENTS

| | | | | |
|---|---|---|---|---|
| 2,663,164 | A * | 12/1953 | Kurtz | 62/468 |
| 5,236,311 | A * | 8/1993 | Lindstrom | 417/254 |
| 2003/0095871 | A1 * | 5/2003 | Hebert | 417/63 |
| 2003/0150223 | A1 * | 8/2003 | Tang et al. | 62/116 |

FOREIGN PATENT DOCUMENTS

| | | | |
|---|---|---|---|
| JP | 4-78472 | U | 7/1992 |
| JP | 4-371759 | A | 12/1992 |
| JP | 6-109337 | A | 4/1994 |
| JP | 7-103594 | A | 4/1995 |
| JP | 7-260263 | A | 10/1995 |
| JP | 7-301465 | A | 11/1995 |
| JP | 2003-279176 | A | 10/2003 |
| JP | 2004-325019 | A | 11/2004 |
| JP | 2004325019 | A * | 11/2004 |

* cited by examiner

*Primary Examiner* — Judy Swann
*Assistant Examiner* — Filip Zec
(74) *Attorney, Agent, or Firm* — Leydig, Voit & Mayer, Ltd.

(57) ABSTRACT

A refrigeration air conditioner includes a first equalizer pipe connecting a bottom portion of a first hermetic vessel, which contains a main compression mechanism and lubricating oil, to a bottom portion of a second hermetic vessel, which contains an expansion mechanism, a sub-compression mechanism, and lubricating oil. A second equalizer pipe connects a side of the second hermetic vessel at a position higher than a minimum oil level to a suction side of the main compression mechanism. The space within the second hermetic vessel is isolated from the expansion mechanism and the sub-compression mechanism, and the pressure within the second hermetic vessel is not dependent upon the pressure within the expansion mechanism and the pressure within the sub-compression mechanism.

11 Claims, 7 Drawing Sheets

DUAL COMPRESSOR AIR CONDITIONING SYSTEM WITH OIL LEVEL REGULATION

TECHNICAL FIELD

This invention relates to a refrigerating air conditioner for use in the air conditioners or the refrigerating machines and including two or more hermetic vessels for containing a compression mechanism therein, and more particularly to an oil equalizing mechanism between the hermetic vessels.

BACKGROUND ART

Some of the refrigerating air conditioners for use in air conditioners or refrigerating machines comprise, in order to improve the COP (Coefficient of Performance), a main compressor for compressing a refrigerant and an expander including an expansion mechanism for expanding the refrigerant and a sub-compression mechanism for converting the expansion energy in the expansion mechanism into a mechanical energy. In such the refrigerating air conditioner, in order to prevent the decrease in the reliability of the main compressor and the expander due to the sticking or abnormal wear of the machine parts, the oil levels in the main compressor and the expander must be regulated so that shortage of the lubricating oil does not occur.

Therefore, in the conventional refrigerating air conditioner, the pressure within the hermetic vessel of the main compressor is arranged to be maintained at the suction pressure, the suction pipe to the main compression mechanism is disposed within the hermetic vessel, its opening portion is positioned above the oil level of the lubricating oil maintained in the hermetic vessel, and an oil recovery hole is provided below the opening portion and at the upper limit position of the adequate oil level within the hermetic vessel of the main compressor (see Patent Document 1, for example).

Also proposed is a refrigerating air conditioner having a first compressor and a second compressor and an equalizing oil pipe communicating the bottom portion of the first compressor with the bottom portion of the second compressor is provided (see Patent Document 2 and Patent Document 3, for example).

Patent Document 1: Japanese Patent Laid-Open No. 2004-325019 (page 8, FIGS. 8 and 9).

Patent Document 2: Japanese Patent Laid-Open No. 7-103594 (pages 3-4, FIG. 1).

Patent Document 3: Japanese Patent Laid-Open No. 6-109337, (page 3, FIG. 1)

DISCLOSURE OF THE INVENTION

Problem to be Solved by the Invention

However, in the refrigerating air conditioner disclosed in Japanese Patent Laid-Open No. 2004-325019, the suction pipe to the main compressor mechanism must be provided within the hermetic vessel for the main compressor, and the position of this suction pipe is also limited.

Also, in the refrigerating air conditioner disclosed in Japanese Patent Laid-Open No. 7-103594 and Japanese Patent Laid-Open No. 6-109337, it is a problem that the two compressors must be located at the same level in order to regulate the oil level of the lubricating oil.

The present invention has been made to solve the above-discussed problems and has as its object the provision of a refrigerating air conditioner that has no limitation on the structure of the main compressor mechanism, and that the lubricating oil levels within the first hermetic vessel and the second hermetic vessel can be regulated without the need for adjusting the installation levels of the first hermetic vessel containing the main compressor mechanism and the second hermetic vessel containing the sub-compressor mechanism.

Measure for Solving the Problems

With the above object in view, the present invention resides in a refrigeration air conditioner comprising a main compression mechanism for compressing a refrigerant; a gas cooler or a heat radiator for cooling the compressed refrigerant; an expansion mechanism for expanding the refrigerant flowing out from said gas cooler to recover power; a sub-compression mechanism disposed on discharge side or suction side of said main compression mechanism for compressing the refrigerant by the power recovered by said expansion mechanism; an evaporator for evaporating the refrigerant expanded at said expansion mechanism; a first hermetic vessel having contained therein said main compression mechanism and a lubricant oil and having an atmosphere at a suction pressure; a second hermetic vessel having contained therein said expansion mechanism, said sub-compression mechanism and said lubricant oil; a first equalizer pipe connecting a bottom portion of said first hermetic vessel and a bottom portion of said second hermetic vessel; a second equalizer pipe connecting a side of said second hermetic vessel at a position higher than the requisite minimum oil level and a suction side of said main compression mechanism; wherein a space within said second hermetic vessel is isolated from said expansion mechanism and said sub-compression mechanism; and a pressure within said second hermetic vessel is independent from the pressure within said expansion mechanism and the pressure within said sub-compression mechanism.

The refrigeration air conditioner of the present invention may comprises a main compression mechanism for compressing a refrigerant; a sub-compression mechanism disposed on discharge side or suction side of said main compression mechanism for compressing a refrigerant; a gas cooler for cooling the compressed refrigerant; an expansion valve for expanding the refrigerant flowing out from said gas cooler; an evaporator for evaporating the refrigerant expanded at said expansion valve; a first hermetic vessel having contained therein said main compression mechanism and a lubricant oil and having an atmosphere at a suction pressure; a second hermetic vessel having contained therein said sub-compression mechanism and said lubricant oil; a first equalizer pipe connecting a bottom portion of said first hermetic vessel and a bottom portion of said second hermetic vessel; a second equalizer pipe connecting a side of said second hermetic vessel at a position higher than the requisite minimum oil level and a suction side of said main compression mechanism; wherein a space within said second hermetic vessel is isolated from said sub-compression mechanism; and a pressure within said second hermetic vessel is independent from the pressure within said sub-compression mechanism.

According to the present invention, a refrigerating air conditioner is provided that has no limitation on the structure of the main compressor mechanism, and that the lubricating oil levels within the first hermetic vessel and the second hermetic vessel can be regulated without the need for adjusting the installation levels of the first hermetic vessel containing the main compressor mechanism and the second hermetic vessel containing the sub-compressor mechanism.

PREFERRED EMBODIMENTS FOR CARRYING OUT THE INVENTION

Embodiment 1

Figure 1:
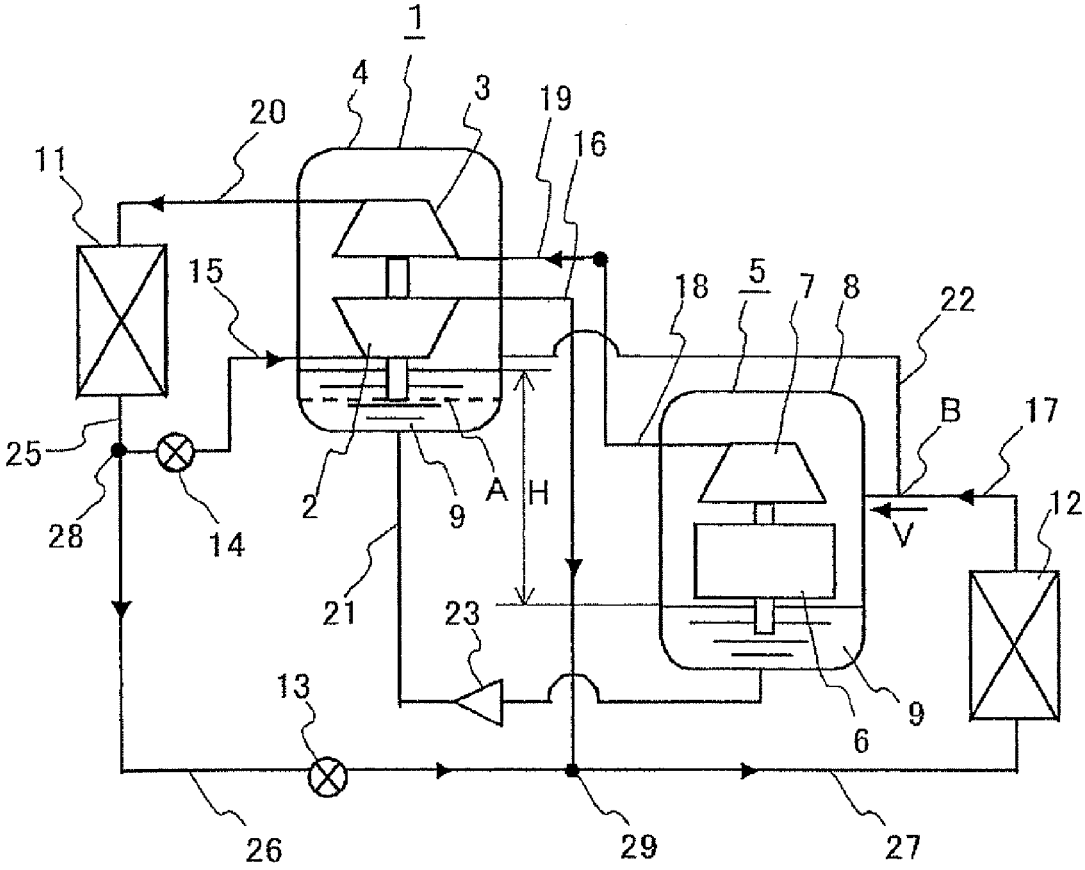
FIG. 1 is a block diagram illustrating the construction of the refrigerating air conditioner according to the embodiment 1 of the present invention.

FIG. 1 is a block diagram illustrating the construction of the refrigerating air conditioner according to the embodiment 1 of the present invention. The arrows in the figure show the direction of flow of the refrigerant. In the figure, the same reference numerals designate the identical or corresponding components and this applies to the entire specification. The embodiments disclosed in this specification are only illustrative and they are not limited thereto. It is assumed in the embodiment 1 of this invention that a refrigerant which reaches the super critical sate at the high pressure side, such as carbon dioxide, is used.

In FIG. 1, an expander 1 comprises an expansion mechanism 2 for expanding the refrigerant and recovering the power and a sub-compression mechanism 3 driven by a power recovered by the expansion mechanism 2 and compressing the refrigerant, the expansion mechanism 2 and the sub-compressor mechanism 3 being contained as an integral structure within the second hermetic vessel 4 in which a lubricating oil 9 for lubricating the sliding parts is maintained in the bottom portion. The main compressor 5 comprises a main compressor mechanism 7 driven by an electric motor mechanism 6 and compressing the refrigerant, and the electric motor mechanism 6 and the main-compressor mechanism 7 are housed as an integral structure within the first hermetic vessel 8 in which the lubricating oil 9 for lubricating the sliding parts is maintained in the bottom portion. As illustrated in FIG. 1, the height at which the second hermetic vessel 4 is installed is higher than the installation level of the first hermetic vessel 8. Here, the installation height of the hermetic vessels 4, 8 refers to a height position at which the bottom plates of the hermetic vessels 4, 8 come into contact with the lubricant oil 9.

The sub-compressor mechanism 3 is disposed on the discharge side of the main-compressor mechanism 7, and the discharge side of the main compressor mechanism 7 and the suction side of the sub-compressor mechanism 3 are connected to each other by means of a main compressor discharge pipe 18 and a sub-compressor suction pipe 19. Also, the discharge side of the sub-compressor mechanism 3 and inlet side of a gas cooler or a heat radiator 11 cooling the refrigerator are connected by a sub-compressor discharge pipe 20. Further, the outlet side of the gas cooler 11 and the suction side of the expansion mechanism 2 are connected to each other by means of a gas cooler outlet pipe 25 and an expander suction pipe 15, and a second expansion valve 14 is provided in the middle of the expander suction pipe 5.

On the other hand, the outlet side of the gas cooler 11 and the inlet side of the evaporator 12 are connected to each other via a bypass pipe 26 and an evaporator flow pipe 27, and a first expansion valve 13 is inserted in the bypass pipe 26. Also, the outlet side of the expansion mechanism 2 and the inlet side of the evaporator 12 are connected to each other via an expander discharge pipe 16 and the evaporator flow pipe 27. The expander suction pipe 15 and the bypass pipe 26 are connected to the gas cooler flow pipe 25 at a branch point 28, and the bypass pipe 26 and the expander discharge pipe 16 are connected to the evaporator flow pipe 27 at the junction point 29. The outlet side of the evaporator 12 and the suction side of the main compressor mechanism 7 are connected to each other via the main compressor suction pipe 17 and the first hermetic vessel 8.

The inner space of the second hermetic vessel 4 is isolated from the expansion mechanism 2 and the sub compressor mechanism 3, so that the pressure within the second hermetic vessel 4 does not depend upon the pressure within the expansion mechanism 2 or the pressure within the main compressor mechanism 3. Also, the pressure within the first hermetic vessel 8 is at the suction pressure because the main compressor suction pipe 17 is connected to the first hermetic vessel 8.

The bottom portion of the second hermetic vessel 4 and the bottom portion of the first hermetic vessel 8 are connected to each other by a first equalizer 21, and the first equalizer pipe 21 is provided with a check valve 23 for preventing the flowing out of the lubricating oil 9 from the second hermetic vessel 4 into the first hermetic vessel 8. An oil level A shown by a dash line In FIG. 1 is a minimum and requisite for lubricating the bearings and the sliding portions. Hereinafter this level A or height will be referred to as "minimum requisite oil level". The second hermetic vessel 4 is connected at the position higher than the position of the minimum requisite oil level A to the main compressor suction pipe 17 which is the suction side of the main compressor mechanism 7 by means of the second hermetic tube 22.

The operation of the refrigerating air conditioner of this embodiment according to the present invention will now be described in conjunction with FIG. 1.

When the main compressor mechanism 7 is driven by the electric motor 6, the refrigerant at low temperature and low pressure and in the gaseous state is suctioned from the main compressor suction pipe 17 into the first hermetic vessel 8. The refrigerant suctioned from the first hermetic vessel 8 to the main compressor mechanism 7 is compressed to an intermediate pressure and discharged from the main compressor discharge pipe 18. The refrigerant at the intermediate pressure introduced into the sub compressor suction pipe 19 from the main compressor discharge pipe 18 is further compressed by the sub compressor mechanism 3 to high temperature and high pressure and discharged into the sub compressor discharge pipe 20. The refrigerant discharged into the sub compressor discharge pipe 20 dissipates its heat at the gas cooler 11 and flows into the gas cooler flow pipe 25. The refrigerant flown out into the gas cooler flow pipe 25 is branched at the branch point 28 into one portion that flows into the expander suction pipe 15 and the other portion that flows into the bypass pipe 26.

The refrigerant introduced into the expander suction pipe 15 is first depressurized at the second expansion valve 14 so that the operation is achieved at the adequate compression ratio at the expansion mechanism 2, and then introduced into the expansion mechanism 2 via the expander suction pipe 15. The refrigerant expanded at the expansion mechanism 2 is now in the vapor-liquid two phase state at low temperature and low pressure and discharged into the expander discharge pipe 16. On the other hand, the refrigerant that flows into the bypass pipe 26 is expanded and depressurized by the first expansion valve 13 in order to regulate the flow rate when the operating conditions of the refrigerating air conditioner is changed. The refrigerant expanded and depressurize at the first expansion valve 13 is joined at the junction point 29 with the refrigerant supplied from the expander discharge pipe 16 and flows into the evaporator 12 via the evaporator flow pipe 27. The refrigerant introduced into the evaporator 12 is heated and evaporated and then flows back into the first hermetic vessel 8 via the main compressor suction pipe 17.

Here, the pressure at the suction side of the main compressor mechanism 7 and the pressure at the discharge side of the expansion mechanism 2 are referred to as a low pressure, and the pressure at the suction side of the expansion mechanism 2 and the pressure at the discharge side of the sub compressor mechanism 3 are referred to as a high pressure, and the pressure at the discharge side of the main compressor mechanism 7 which is at the suction side of the sub compressor mechanism 3 is referred to as an intermediate pressure.

Then the behavior of the lubricating oil 9 within the second hermetic vessel 4 and the first hermetic vessel 8 during the above-discussed operation will now be described in conjunction with FIG. 1. In FIG. 1, it is assumed that the difference in height between the oil level position of the lubrication oil level in the second equalizing pipe 22 and the second hermetic vessel 4 and the oil level position within the first hermetic vessel 8 discharge is H, then the pressure difference $\Delta P_1$ produced by the level difference H is given by equation (1):

$$\Delta P_1=\rho_o gH \quad (1)$$

where, $\rho_o$ is density of the lubricating oil 9 and g is the gravitational acceleration.

On the other hand, assuming that the flow speed of the vaporized refrigerant within the main compressor suction pipe 17 at the connecting point B between the second equalizer pipe 22 and the main compressor suction pipe 17 is V, then the dynamic pressure $\Delta P_2$ is given by equation (2):

$$\Delta P_2=\rho_r V^2/2 \quad (2)$$

where, $\rho_r$ is the density of the vaporized refrigerant.

The pressure $P_b$ within the second hermetic vessel 4 is the pressure that does not depend upon the pressure within the expansion mechanism 2 or the pressure within the sub compressor mechanism 3, and since the second hermetic vessel 4 and the main compressor suction pipe 17 are connected to each other, the pressure $P_b$ within the second hermetic vessel 4 is always lower than the pressure $P_a$ within the first hermetic vessel 8 by $\Delta P_2$. Therefore, the dynamic pressure $\Delta P_2$ generated by the flow speed V of the vaporized refrigerant is also given by equation (3):

$$\Delta P_2=P_a-P_b \quad (3)$$

When the flow speed V of the gaseous refrigerant in the main compressor suction pipe 17 is large and $\Delta P_2>\Delta P_1$, the lubricating oil 9 flows from the first hermetic vessel 8 to the second hermetic vessel 4 through the first equalizer pipe 21 against the pressure difference $\Delta P_1$ due to the height difference H between the oil level within the second hermetic vessel 4 and the first hermetic vessel 8, whereby the oil level within the second hermetic vessel 4 is elevated. When the oil level within the second hermetic vessel 4 is elevated and reaches to the height of the second equalizer pipe 22, the lubricating oil flows out through the second equalizer pipe 22 into the main compressor suction pipe 17. The lubricating oil 9 introduced into the main compressor suction pipe 17 is lead into the first hermetic vessel 8, increasing the oil amount within the first hermetic vessel 8, whereby the oil level within the respective hermetic vessels 4 and 8 are regulated.

Contrary to the above, when the flow speed V of the gaseous refrigerant in the main compressor suction pipe 17 is small and $\Delta P_2<\Delta P_1$, the lubricating oil 9 tends to flow from the side of the second hermetic vessel 4 into the first hermetic vessel 8. However, the check valve 23 prevents the lubricating oil 9 from flowing into the first hermetic vessel 8 from the side of the second hermetic vessel 4, but the oil level within the second hermetic vessel 4 is not lowered and is maintained.

Also, even when the second hermetic vessel 4 is installed at a high position and the height difference H between the oil level within the second hermetic vessel 4 and the oil level within the first hermetic vessel 8 is large, the oil levels within the respective hermetic vessels 4 and 8 are regulated by the above-discussed function.

As has been described, the refrigerating air conditioner according to the first embodiment of the present invention comprises the first equalizing pipe 21 connecting the first hermetic vessel 8 and the second hermetic vessel 4 at their bottom portions and the second equalizing pipe 22 connecting the second hermetic vessel 4 at a position on the side above the requisite minimum oil level A to the suction side of the main compressor mechanism 7, the inside of the first hermetic vessel 8 being filled with an atmosphere at the suction pressure and the inside space of the second hermetic vessel 4 being isolated from the expansion mechanism 2 and the sub expansion mechanism 3, and the pressure in the second hermetic vessel 4 does not depend upon the pressure within the expansion mechanism 2 or the sub compressor mechanism 3. Therefore, the oil level in the respective hermetic vessels 4 and 8 can be automatically regulated irrespective of the flow speed V of the gaseous refrigerant in the main compressor mechanism 2 and the sub compressor mechanism 3, or the amount of the height difference H between the oil level in the second hermetic vessel 4 and the first hermetic vessel 8. Therefore, the decrease of the reliability due to the sticking or abnormal wear of the sliding parts of the main compressor 5 and the expander 1.

Next, a scroll type expander will now be described in terms of its structure and the operation as an example of the expander 1 having the expansion mechanism 2 and the sub compressor mechanism 3 driven by the power recovered by the expansion mechanism 2 and compressing the refrigerant according to the first embodiment of the present invention.

Figure 2:
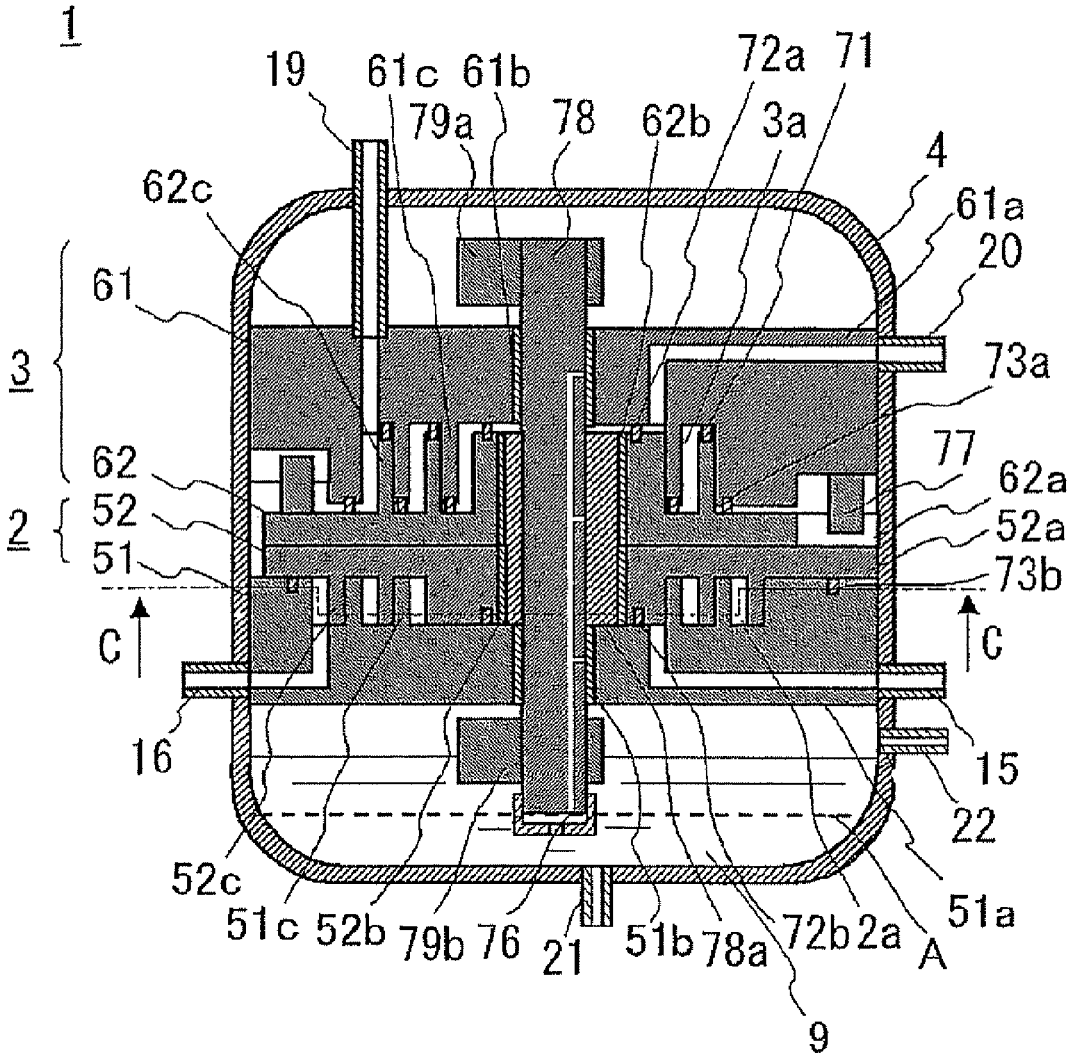
FIG. 2 is a longitudinal sectional view illustrating the structure of the expander according to the embodiment 1 of the present invention.

FIG. 2 is a longitudinal sectional view illustrating the structure of the scroll type expander according to the embodiment 1 of the present invention.

In FIG. 2, in the lower portion of the second hermetic vessel 4, the expansion mechanism 2 is disposed and in the upper portion of the expansion mechanism 2, the sub compressor mechanism 3 is disposed. The expansion mechanism 2 comprises a first fixed scroll 51 having a scroll wrap 51*c* formed on a base plate 51*a* and a first orbiting scroll 52 having a scroll wrap 52*c* formed on a base plate 52*a*, the scroll wrap 51*c* of the first fixed scroll 51 and the scroll wrap 52*c* of the first orbiting scroll 52 are being arranged to mesh with each other. The sub compressor mechanism 3 comprises a second fixed scroll 61 having a scroll wrap 61*c* formed on a base plate 61*a* and a second orbiting scroll 62 having a scroll wrap 62*c* formed on a base plate 62*a*, the scroll wrap 61*c* of the second fixed scroll 61 and the scroll wrap 62*c* of the second orbiting scroll 62 are being arranged to mesh with each other.

A shaft 78 is rotatably supported at both ends by bearing portions 51*b* and 61*b* each disposed at the center of the first fixed scroll 51 and the second fixed scroll 61. The first orbiting scroll 52 and the second orbiting scroll 62 are respectively passed through and supported at an eccentric bearing portions 52*b* and 62*b* formed in their centers by a crank portion 78*a* fitted on the shaft 79 so that they achieve orbiting motions. The requisite minimum oil level A is at the lower end of the shaft 78, which is the minimum oil level of the lubricating oil 9 necessary for lubricating the bearing portion 51*b* and 61*b* as well as the eccentric bearing portions 52*b* and 62*b*.

Provided on the side wall of the second hermetic vessel 4 and at the outer circumference of the expansion mechanism 2 are the expander suction pipe 15 for sucking the refrigerant and the expander discharge pipe 16 for discharging the expanded refrigerant. On the other hand, on the upper wall of the second hermetic vessel 4 and above the sub compressor mechanism 3, the sub compressor mechanism suction pipe 19 for sucking the refrigerant is provided, and on the side wall of the second hermetic vessel 4 and at the outer circumference of the sub compressor mechanism 3, the sub compressor discharge pipe 20 for discharging the compressed refrigerant is provided.

Also, on the bottom portion of the second hermetic vessel 4, the first equalizer pipe 21 is connected for communicating the bottom portion of the first hermetic vessel 8, and on the side wall of the second hermetic vessel 4 and at the position higher than the requisite minimum oil level A, the second equalizer pipe 22 for the connection to main compressor suction pipe 17.

In the sub compressor mechanism 3, the spiral teeth 61*c* and 62*c* of the first fixed scroll 61 and the second orbiting scroll 62 has mounted, on their respective tips, tip seals 71 for sealing a sub-compression chamber 3*a* defined between the scroll wrap 61*c* of the second fixed scroll 61 and the scroll wrap 62*c* of the second orbiting scroll 62. Also, an inner circumferential seal 72*a* is disposed on the surface of the second orbiting scroll 62 facing to the second fixed scroll 61 and at the outer circumference of the eccentric bearing portion 62*b* to function as a seal member for sealing between the second orbiting scroll 62 and the fixed scroll 61. Further, an outer circumferential seal 73*a* is disposed on the surface of the second fixed scroll 61 facing to the second orbiting scroll 61 and at the outer circumference of the scroll wrap 61*c* to function as a seal member for sealing between the second orbiting scroll 62 and the fixed scroll 61.

On the other hand, in the expansion mechanism 2, similarly to the sub-compressor mechanism 3, an inner circumferential seal 72*b* is disposed on the surface of the first orbiting scroll 52 facing to the first orbiting scroll 52 and at the outer circumference of the eccentric bearing portion 52*b* to function as a seal member for sealing between the first orbiting scroll 52 and the first fixed scroll 51. Further, an outer circumferential seal 73*b* is disposed on the surface of the first fixed scroll 51 facing to the first fixed scroll 51 and at the outer circumference of the scroll wrap 51*c* to function as a seal member for sealing between the first orbiting scroll 52 and the first fixed scroll 51. Further, the outer circumference portion of the base plate 51*a* of the first fixed scroll 51 and the outer circumference portion of the base plate 52*a* of the first fixed scroll 52 are arranged to contact to each other.

The first orbiting scroll 52 and the second orbiting scroll 62 are joined together by a connecting element such as a pin and prevented from the rotation by an Oldham's ring 77 disposed in the sub-compressor mechanism 3. Also, in order to cancel out the centrifugal forces generated by the rotation of the orbiting scrolls 52, 62, balance weights 79*a*, 79*b* are attached to both ends of the shaft 78. The first orbiting scroll 52 and the second orbiting scroll 62 may by made in one piece member with the base plates 52*a*, 62*a* arranged as a common member.

In the expansion mechanism 2, the power is generated by the expansion of the high pressure refrigerant suctioned from the expander suction pipe 15 within the expansion chamber 2*a* defined by the scroll wrap 51*c* of the first fixed scroll 51 and the scroll wrap 52*c* of the first orbiting scroll 52. The refrigerant expanded and decompressed within the expansion chamber 2*a* is discharged from the expander discharge pipe 16 to the exterior of the second hermetic vessel 4. The power generated at the expansion mechanism 2 compresses and pressure-raises the refrigerant introduced from the sub-compressor suction pipe 19 within the sub-compression chamber 3*a* of the sub-compressor mechanism 3. The refrigerant compressed and pressure-raised within the sub-compression chamber 3*a* is discharged from the sub-compressor machine discharge pipe 20 to the exterior of the second hermetic vessel 4.

The expansion mechanism 2 achieves the expansion step from the high pressure to the low pressure, and the sub-compression mechanism 3 achieves the compression step from the intermediate pressure to the high pressure. Therefore, in the orbiting scrolls 52 and 62, a high pressure acts on both of the expansion chamber 2*a* at the center and the sub-compression chamber 3*a* at the center, a low pressure acts on the expansion chamber 2*a*, and an intermediate pressure acts on the outer circumferential 3*a*. The sub-compression chamber 3*a* and the space within the second hermetic vessel 4 are isolated from by an inner circumferential seal 72*a* and an outer circumferential seal 73*a*, and the expansion chamber 2*a* and the space defined in the second hermetic vessel 4.

Figure 3:
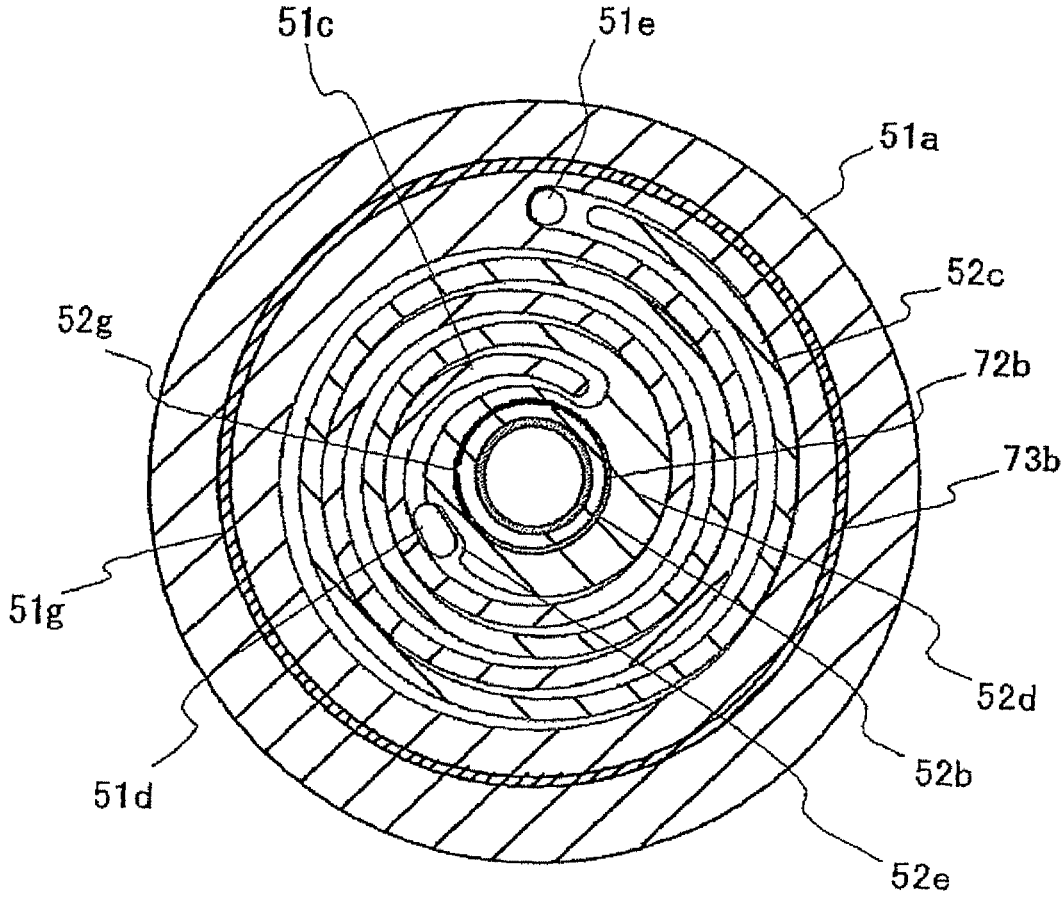
FIG. 3 is a cross sectional view illustrating the expansion mechanism of the expander according to the embodiment 1 of the present invention.

FIG. 3 is a cross sectional view taken along the line C-C of the expansion mechanism of the expander, shown in FIG. 2, according to the embodiment 1 of the present invention.

At the inner end portion of the scroll wrap 52*c* of the first orbiting scroll 52, a thick portion 52*d* is provided, and the thick portion 52*d* has formed therein an eccentric bearing portion 52*b* extending therethrough for allowing a crank portion 78 to be inserted therein. Formed on the thick portion 52*d* of the first orbiting scroll 52 and in the outer circumference of the eccentric bearing portion 52*b* is an inner seal groove 52*g*, and an inner seal 72*b* is inserted within the inner seal groove 52*g*. Also, formed on the base plate 51*a* of the first fixed scroll 51 and in the outer circumference of the scroll wrap 51*c* is an outer seal groove 51*g*, and an outer seal 73*b* is inserted therein.

The base plate 51*a* of the first fixed scroll 51 is provided with a suction port 51*d* for sucking the refrigerant and a discharge port 51*e* for discharging the refrigerant. The suction port 51*d* has an elongated hole-shape for maintaining the opening area and is connected to the expander suction pipe 15. Also, a notch portion 52*e* is provided in the thick portion 52*d* in order to decrease the area that closes the suction port 51*d* during the orbiting motion. The discharge port 51*e* is disposed at the position in which it does not interfere with the outer end portion of the scroll wrap 52*c* of the first orbiting scroll 52 and connected to the expander discharge pipe 16.

Figure 4A:
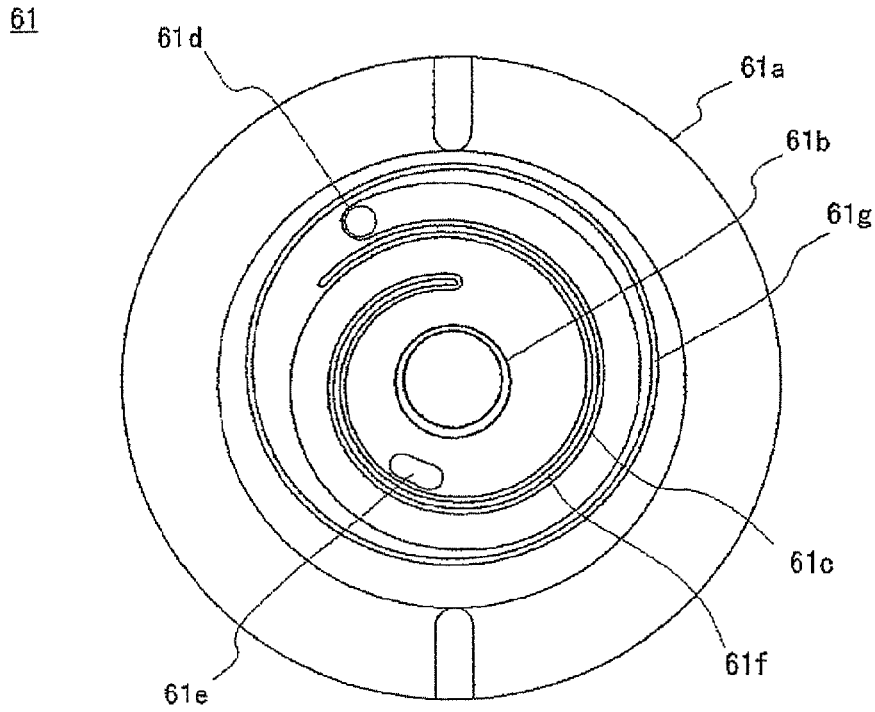
FIG. 4(*a*) is a plan view of a second scroll and FIG. 4(*b*) is a plan view of a second orbiting scroll of a sub-compression mechanism of the expander according to the embodiment 1 of the present invention.
Figure 4B:
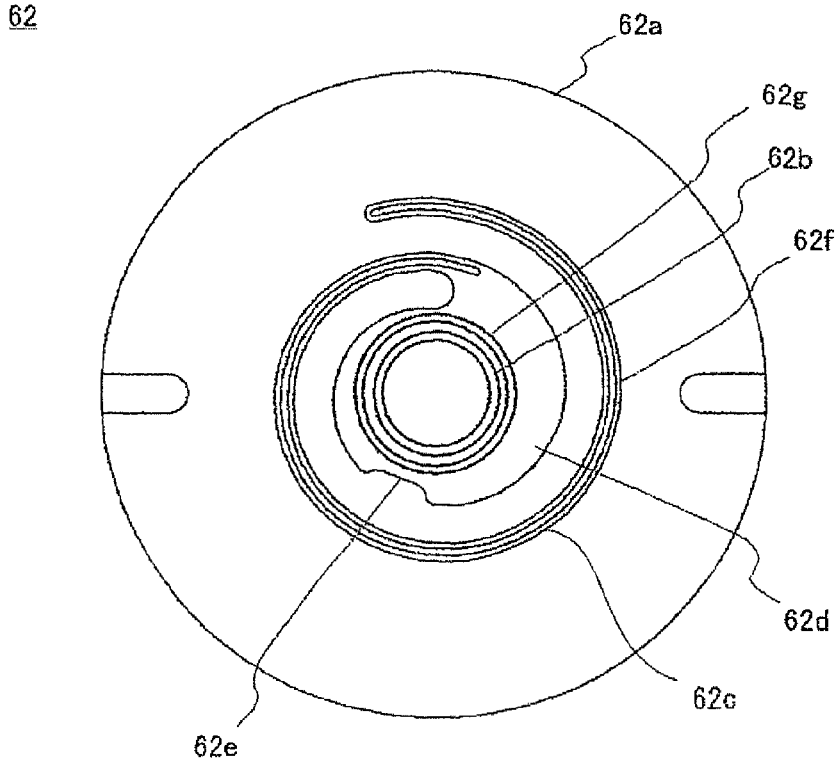

FIG. 4(*a*) is a plan view of the second scroll and FIG. 4(*b*) is a plan view of the second orbiting scroll of the sub-compressor mechanism of the expander according to the embodiment 1 of the present invention.

As shown in FIGS. 4(*a*) and 4(*b*), the scroll wraps 61*c*, 62*c* of the sub-compressor mechanism 3 are wrapped in the same scroll direction as the expansion mechanism 2, so that, when the second orbiting scroll 62 and the first orbiting scroll 52 are combined, back-to-back, and make an orbiting motion together, they achieve compression on one side and expansion on the other side.

At the inner end portion of the scroll wrap 62*c* of the second orbiting scroll 62, a thick portion 62*d* is provided and, similarly to the first orbiting scroll 52 of the expansion mechanism 2, an eccentric bearing portion 62*b* into which a crank portion 78*a* is inserted is formed to extend therethrough. Also, the base plate 61*a* of the second fixed scroll 61 is provided with a suction port 61*d* for sucking the refrigerant and a discharge port 61*e* for discharging the refrigerant. The discharge port 61*e* has an elongated hole shape for maintaining the opening area and is connected to the sub-compressor suction pipe 20. Also, a notch portion 62*e* is provided in the thick portion 62*d* in order to decrease the area that closes the discharge port 61*e* during the orbiting motion. The suction port 61*d* is disposed at the position in which it does not interfere with the outer end portion of the scroll wrap 62*c* of the second orbiting scroll 62 and connected to the sub-compressor suction pipe 19.

In the tip end surfaces of the scroll wraps 61*c*, 62*c*, tip seal grooves 61*f*, 62*f* are formed for receiving therein tip seals 71. In the thick portion 62*d* of the second orbiting scroll 62 and in the outer circumference of the eccentric bearing portion 62*b*, an inner circumference groove 62*g* for inserting an inner seal 72*a* is formed. Also, on the base plate 61*a* of the second fixed scroll 61 and in the outer circumference of the scroll wrap 61*c*, an outer seal groove 61*g* for inserting the outer seal 73*a*.

Figure 5:
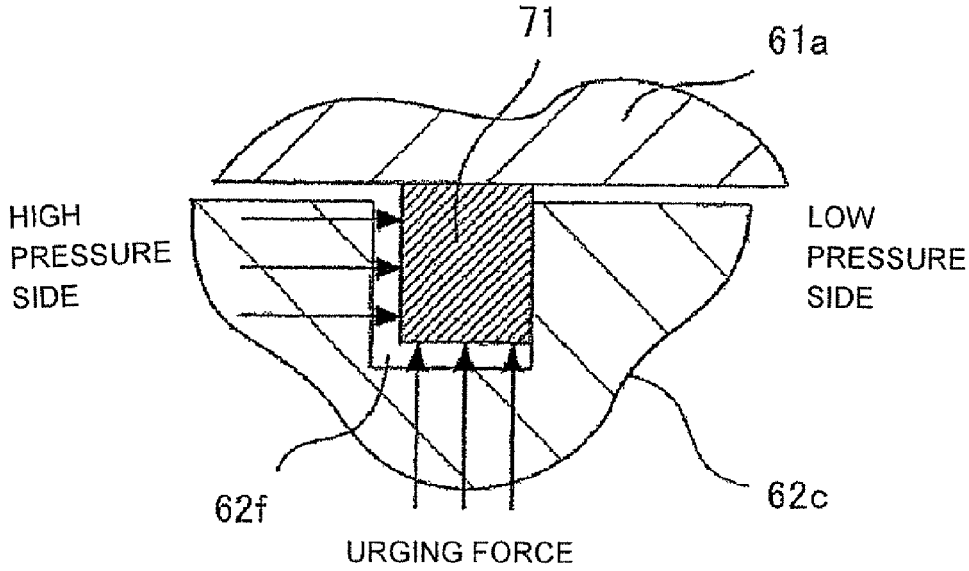
FIG. 5 is a cross sectional view for explaining the contact seal function of the generally conventional contact seal.

FIG. 5 is a cross sectional view for explaining the contact seal function of the tip seal.

In FIG. 5, the tip seal 71 is pressed from the left and the above as shown by the arrows, which are high pressure side, according to the pressure difference between the sub-compressor chamber 3*a* at both sides of the partition. Therefore, the tip seal 71 is urged within the tip seal groove 62 for the tip seal 71 against the right hand wall and the above base plate 61*a* to provide the contact seal between the second orbiting scroll 62 and the fixed scroll 61. The contact seal functions of the inner seal 72*a* and 72*b* and the outer seal 73*a* and 73*b* are similar to contact seal function of the tip seal 71.

In the expander of the scroll type as above described, the inner seals 72*a*, 72*b* are disposed on the inner circumference portion of the first orbiting scroll 52 and the inner circumference portion of the second orbiting scroll 62, and the outer seals 73*a*, 73*b* are disposed on the outer circumference portion of the first fixed scroll 51 and the outer circumference portion of the second fixed scroll 61. Therefore, the space within the second hermetic vessel 4 is isolated from the expansion mechanism 2 and the sub-compressor mechanism 3, so that the pressure within the second hermetic vessel 4 does not depend upon the pressure within the expansion mechanism 2 and the pressure within the sub-compressor mechanism 3, whereby the oil level can be stably regulated In this embodiment, the inner seals 72*a*, 72*b* which are seal members are disposed on the inner circumference portion of the first orbiting scroll 52 and the inner circumference portion of the second orbiting scroll 62, but the inner seals 72*a*, 72*b* which are seal members may be disposed on the inner circumference portion of the first fixed scroll 51 and the inner circumference portion of the second fixed scroll 52. Also, in this embodiment, the outer seals 73*a*, 73*b* which are seal members are disposed on the outer circumference portion of the first fixed scroll 51 and the outer circumference portion of the second fixed scroll 61, but the outer seals 73*a*, 73*b* which are seal members may be disposed on the outer circumference portion of the first orbiting scroll 52 and the outer circumference portion of the second orbiting scroll 62.

Further, in this embodiment, the scroll type expander is described as the expander 1 used in the refrigerating air conditioner, but any type of expander such as multi-vane type or rotary type machine may equally be used as long as the pressure within the second hermetic vessel 4 does not depend upon the pressure within the expansion mechanism 2 and the pressure within the sub-compressor mechanism 3.

Also, in this embodiment, the centrifugal pump 76 is described as the pump for feeding the lubricating oil 9 into the bearing and the sliding portion, but any type of pump such as a volume-type pump including the troquoid pump may equally be used. When a volume-type pump is used, the level of the suction port of the pump is the requisite minimum oil level.

Embodiment 2

In embodiment 1, the description has been made as to the refrigerating air conditioner in which the installation level of the second hermetic vessel 4 is higher than the installation level of the first hermetic vessel 8. In embodiment 2, the description will be made as to a refrigerating air conditioner in which the installation level of the second hermetic vessel 4 is lower than the installation level of the first hermetic vessel B.

Figure 6:
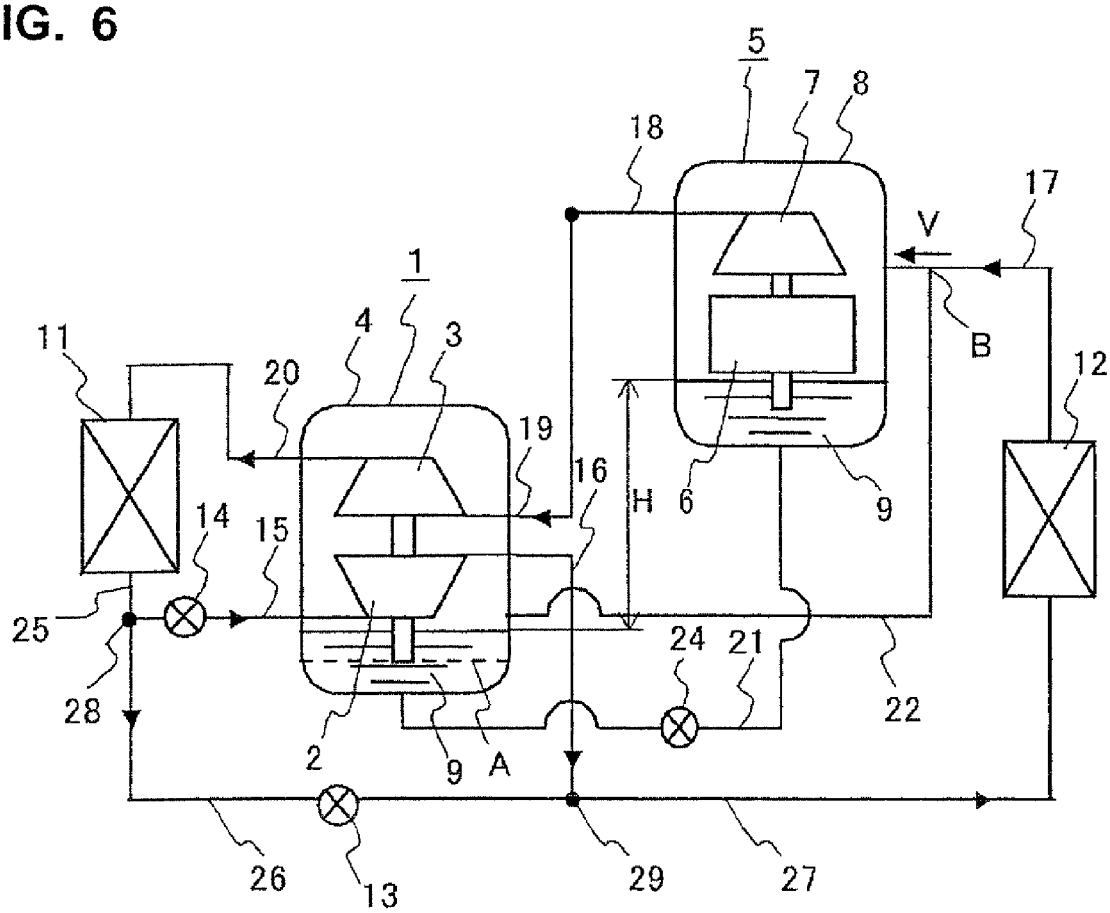
FIG. 6 is a block diagram illustrating the construction of the refrigerating air conditioner according to the embodiment 2 of the present invention.

FIG. 6 is a block diagram illustrating the construction of the refrigerating air conditioner according to the embodiment 2 of the present invention The refrigerating air conditioner of embodiment 2 of the present invention is different from the refrigerating air conditioner of the embodiment 1 in that, as shown in FIG. 6, the installation level of the second hermetic vessel 4 is lower than the installation level of the first hermetic vessel 8, and an electromagnetic valve 24 instead of the check valve 23 is disposed in the first equalizer pipe 21. In other respects, the structure is the same as that of the refrigerating air conditioner of embodiment 1.

The behavior of the lubricating oil 9 within the second hermetic vessel 4 and the first hermetic vessel 8 of embodiment 2 will now be described in terms of FIG. 6. In FIG. 6, since the installation level of the second hermetic vessel 4 is lower than the installation level of the first hermetic vessel 8, the pressure difference $\Delta P_1$ generated due to the height difference H between the oil level in the second hermetic vessel 4 and the oil level in the first hermetic vessel 8 causes the oil level within the first hermetic vessel 8 to be lowered. Also, the pressure difference $\Delta P_2$ given by equation (2) generates a force that lowers the oil level within the first hermetic vessel 8, so that the lubricating oil 9 flows out through the second equalizer pipe 23 into the main compressor suction pipe 17 irrespective of the flow speed V of the gas refrigerant in the main compressor suction pipe 17.

The lubricating oil 9 flows into the main compressor suction pipe 17 is introduced into the first hermetic vessel 8 to increase the oil amount within the first hermetic vessel 8, so that the oil level in each of the hermetic vessels 4 and 8 is regulated. Therefore, the check valve 23 is not necessary in the first equalizer pipe 21. When the refrigeration air conditioner is not operated, it is necessary to prevent the lubricating oil 9 within the first hermetic vessel 8 from moving into the second hermetic vessel 4 via the first equalizer pipe 21 due to the level difference H. Thus, the arrangement is such that the electromagnetic valve 24 disposed in the first equalizer pipe 21 is closed when the refrigerating air conditioner is not operated. The electromagnetic valve 24 is open when the refrigerating air conditioner is operated.

As has been described, the refrigerating air conditioner according to embodiment 2 of the present invention comprises the first equalizer pipe 21 connecting the bottom portion of the first hermetic vessel 8 and the bottom portion of the second hermetic vessel 4, and the second equalizer pipe 22 connecting the side of the second hermetic vessel 4 at a position higher than the requisite minimum oil level A and the suction side of the main compression mechanism 7, the inside of the first hermetic vessel 8 being filled with an atmosphere at the suction pressure, the space within the second hermetic vessel 4 being isolated from the sub-compression mechanism 3, and the pressure within the second hermetic vessel 4 being independent from the pressure within the sub-compression mechanism 3. Therefore, the oil level in the respective hermetic vessels 4 and 8 can be automatically regulated irrespective of the flow speed V of the gaseous refrigerant in the main compressor mechanism suction pipe 17, or the amount of the level difference H between the oil level in the second hermetic vessel 4 and the oil level in the first hermetic vessel 8. Therefore, the decrease of the reliability due to the sticking or abnormal wear of the sliding parts of the main compressor 5 and the expander 1.

In embodiment 2 of the present invention, the description has been made as to the refrigerating air conditioner in which the installation level of the second hermetic vessel 4 is lower than the installation level of the first hermetic vessel 8, but the same applies to the refrigerating air conditioner in which the installation level of the second hermetic vessel 4 is the same as the installation level of the first hermetic vessel 8. When the installation level of the second hermetic vessel 4 is the same as the installation level of the first hermetic vessel 8, the electromagnetic valve 24 is not necessary.

As apparent from embodiment 1 and embodiment 2, the refrigeration air conditioner of the present invention comprises the first equalizer pipe 21 connecting the bottom portion of the first hermetic vessel 8 and the bottom portion of the second hermetic vessel 4, and the second equalizer pipe 22 connecting the side of the second hermetic vessel 4 at the position higher than the requisite minimum oil level A and the suction side of the main compression mechanism 7, and the space within the second hermetic vessel 4 is isolated from the expansion mechanism 2 and the sub-compression mechanism, and the pressure within the second hermetic vessel 4 is independent from the pressure within the expansion mechanism 2 and the pressure within the sub-compression mechanism 3. Therefore, the oil level in the respective hermetic vessels 4 and 8 can be automatically regulated irrespective of the installation level of each of the first hermetic vessel 8 and the second hermetic vessel 4. Therefore, the decrease of the reliability due to the sticking or abnormal wear of the sliding parts of the main compressor 5 and the expander 1.

Embodiment 3

In the embodiment 1 and embodiment 2, the refrigerant air conditioner having the sub-compression mechanism 3 disposed on the discharge side of the main compression mechanism 7 is described. In embodiment 3, a refrigerating air conditioner in which the sub-compression mechanism 3 is disposed on the suction side of the main compression mechanism 7.

Figure 7:
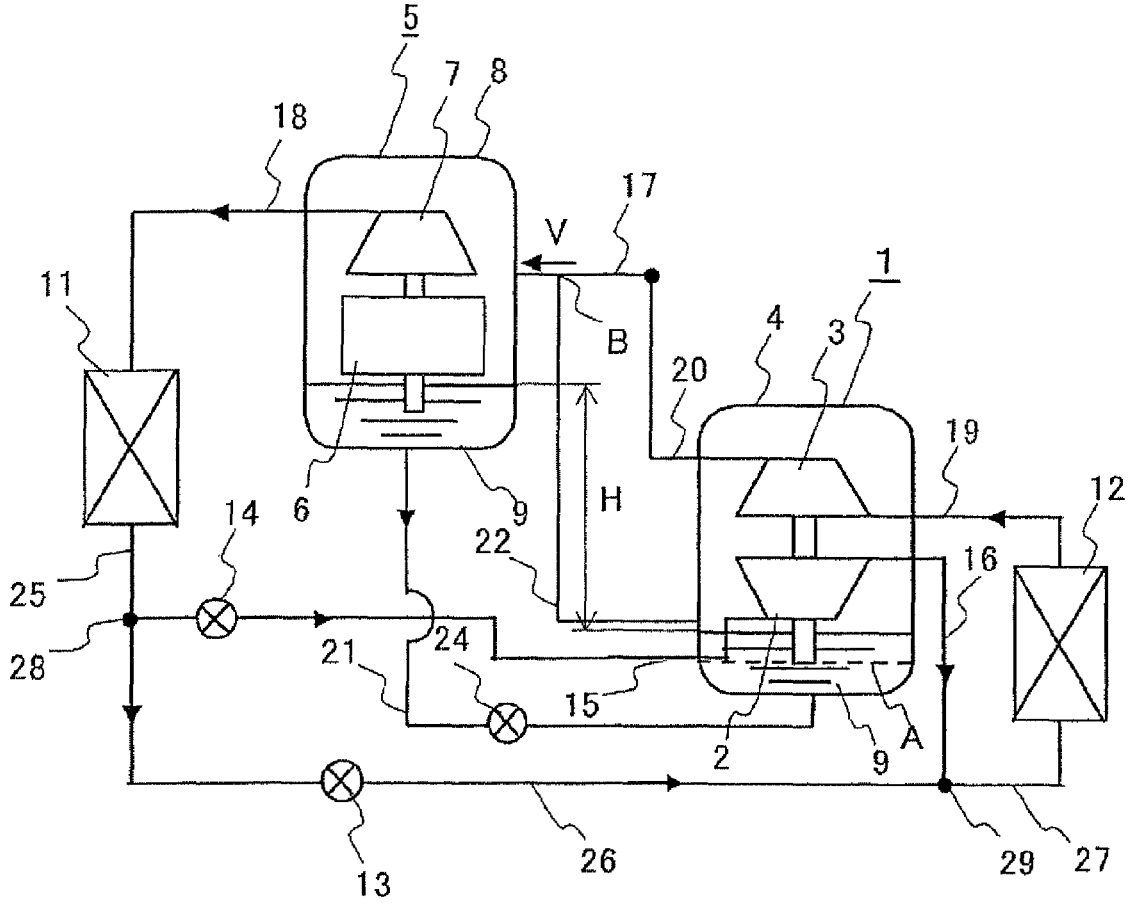
FIG. 7 is a block diagram illustrating the construction of the refrigerating air conditioner according to the embodiment 3 of the present invention.

FIG. 7 is a block diagram illustrating the construction of the refrigerating air conditioner according to the embodiment 3 of the present invention.

In FIG. 7, the sub-compression mechanism 3 is disposed on the suction side of the main compression mechanism 7, and the discharge side of the sub-compression mechanism 3 and the suction side of the main compression mechanism 7 are connected to each other via the sub-compression discharge pipe 20, the main compressor suction pipe 17 and the first hermetic vessel 8. Also, the discharge side of the main compression mechanism 7 and the inlet side of the gas cooler 11 are connected to each other via the main compressor discharge pipe 18. On the other hand, the outlet side of the evaporator 12 and the suction side of the sub-compression mechanism 3 are connected via the sub-compressor suction pipe 19. As seen from FIG. 7, the installation level of the second hermetic vessel 4 is lower than the installation level of the first hermetic vessel 8. In other respects, the arrangement is the same as that of the refrigerating air conditioner of embodiment 2.

The operation of the refrigerating air conditioner according to embodiment 3 of the present invention will now be described in conjunction with FIG. 7.

When the main compression mechanism 7 is driven by the electric motor mechanism 6, the refrigerant in the gas state pressurized to the intermediate pressure in the sub-compression mechanism flows from the main compressor suction pipe 17 into the first hermetic vessel 8, and it is suctioned by the main compression mechanism 7 when the first hermetic vessel 8 reaches to the intermediate pressure atmosphere. The refrigerant in the gas state that is further compressed in the main compression mechanism 7 into the high temperature, high pressure refrigerant, is discharged into the main compressor discharge pipe 18. The refrigerant in the gas state discharged into the main compression discharge pipe 18 flows out to the gas cooler flow pipe 25 after it dissipates heat in the gas cooler 11. One portion of the refrigerant flowed into the gas cooler flow pipe 25 is lead to the expander suction pipe 15 at the junction 28, the remaining portion being lead to the bypass pipe 26.

The refrigerant lead into the expander suction pipe 15 is decompressed by the second expansion valve 14 so that it is worked in the expansion mechanism 2 at a proper compression ratio and then lead from the expander suction pipe 15 into the expansion mechanism 2, where it is expanded. The refrigerant expanded in the expansion mechanism 2 becomes into the low temperature and low pressure liquid-gas phase state and discharged into the expander discharge pipe 16. On the other hand, the refrigerant lead into the bypass pipe 26 is expanded and decompressed by the first expansion valve 13 so the flow rate may be regulated when the operating conditions of the refrigerating air conditioner are changed. The refrigerant expanded and decompressed at the first expansion valve 13 joins with the refrigerant discharged into the expander discharge pipe 16 at the junction point 29 and introduced into the evaporator 12 via the evaporator inlet pipe 27. The refrigerant introduced into the evaporator 12 is suctioned into the sub-compression mechanism 3 via the sub-compressor suction pipe 19 after it is heated and evaporated. The refrigerant suctioned into the sub-compression mechanism 3 is compressed to the intermediate pressure and discharged into the sub-compressor discharge pipe 20. The refrigerant discharged into the sub-compressor discharge pipe 20 flows through the main compressor suction pipe 17, flows into the first hermetic vessel 8 and again suctioned into the main compression mechanism 7.

Here, the pressure on the suction side of the sub-compression mechanism 3 and the pressure on the discharge side of the expansion mechanism 2 are referred to as low pressures, the pressure on the suction side of the expansion mechanism 2 and the pressure on the discharge side of the main compression mechanism 7 are referred to as high pressures, and the pressure on the discharge side of the sub-compression mechanism 3 which is the pressure on the suction side of the main compression mechanism 7 are referred to as intermediate pressures.

Next, the behavior of the lubricating oil 9 within the second hermetic vessel 4 and within the first hermetic vessel 8 during the above operation will now be described in conjunction with FIG. 7. In FIG. 7, the pressure $P_a$ in the first hermetic vessel 8 is an intermediate pressure and, since the pressure $P_b$ in the second hermetic vessel 4 is independent of the pressure in the expansion mechanism 2 and the pressure in the sub-compression mechanism 3, the pressure difference $\Delta P2_2$ is given by the equation (2) in the similar manner as to embodiments 1 and 2.

Therefore, as in the refrigerating air conditioner according to embodiment 2, the lubricating oil 9 flows through the second equalizer pipe 22 to flows out from the second hermetic vessel 4 into the main compressor suction pipe 17. The lubricating oil 9 flows into the main compressor suction pipe 17 is lead into the first hermetic vessel 8 to increase the oil amount within the first hermetic vessel 8, whereby the oil levels in the respective hermetic vessels are regulated.

As has been described, the refrigerating air conditioner according to embodiment 3 of the present invention comprises the first equalizer pipe 21 connecting the bottom portion of the first hermetic vessel 8 and the bottom portion of the second hermetic vessel 4, and the second equalizer pipe 22 connecting the side of the second hermetic vessel 4 at a position higher than the requisite minimum oil level A and the suction side of the main compression mechanism 7, the inside of the first hermetic vessel 8 being filled with an atmosphere at the suction pressure, the space within the second hermetic vessel 4 being isolated from the sub-compression mechanism 3, and the pressure within the second hermetic vessel 4 being independent from the pressure within the sub-compression mechanism 3. Therefore, the oil level in the respective hermetic vessels 4 and 8 can be automatically regulated irrespective of the flow speed V of the gaseous refrigerant in the main compressor mechanism suction pipe 17, or the amount of the level difference H between the oil level in the second hermetic vessel 4 and the oil level in the first hermetic vessel 8. Therefore, the decrease of the reliability due to the sticking or abnormal wear of the sliding parts of the main compressor 5 and the expander 1.

The description has been made as to the refrigerating air conditioner in which the installation level of the second hermetic vessel 4 is lower than the installation level of the first hermetic vessel 8, but even when the installation level of the second hermetic vessel 4 is the same as the installation level of the first hermetic vessel 8, the behavior of the lubricating oil is the same and similar advantageous results can be obtained. When the installation level of the second hermetic vessel 4 is higher than the installation level of the first hermetic vessel 8, the lubricating oil 9 operates in a manner similar to that of embodiment 1 and similar advantageous results discussed in conjunction with the refrigerating air conditioner according to embodiment 1 can be obtained.

Accordingly, as apparent from embodiment 1 to embodiment 3, the refrigeration air conditioner of the present invention comprises the first equalizer pipe 21 connecting the bottom portion of the first hermetic vessel 8 and the bottom portion of the second hermetic vessel 4, and the second equalizer pipe 22 connecting the side of the second hermetic vessel 4 at the position higher than the requisite minimum oil level A and the suction side of the main compression mechanism 7, the inside of the first hermetic vessel 8 being filled with an atmosphere at the suction pressure, the space within the second hermetic vessel 4 is isolated from the expansion mechanism 2 and the sub-compression mechanism, and the pressure within the second hermetic vessel 4 is independent from the pressure within the expansion mechanism 2 and the pressure within the sub-compression mechanism 3. Therefore, the oil level in the respective hermetic vessels 4 and 8 can be automatically regulated irrespective of the installation level of each of the first hermetic vessel 8 and the second hermetic vessel 4. Therefore, the decrease of the reliability due to the sticking or abnormal wear of the sliding parts of the main compressor 5 and the expander 1.

Embodiment 4

In the embodiment 1 to embodiment 3, the refrigerant air conditioner having the expansion mechanism 2 and the sub-compression mechanism 3 disposed within hermetic vessel 4. In embodiment 4, a refrigerating air conditioner in which the sub-compression mechanism 3 driven by the electric motor mechanism 6 is disposed within the second hermetic vessel 4.

Figure 8:
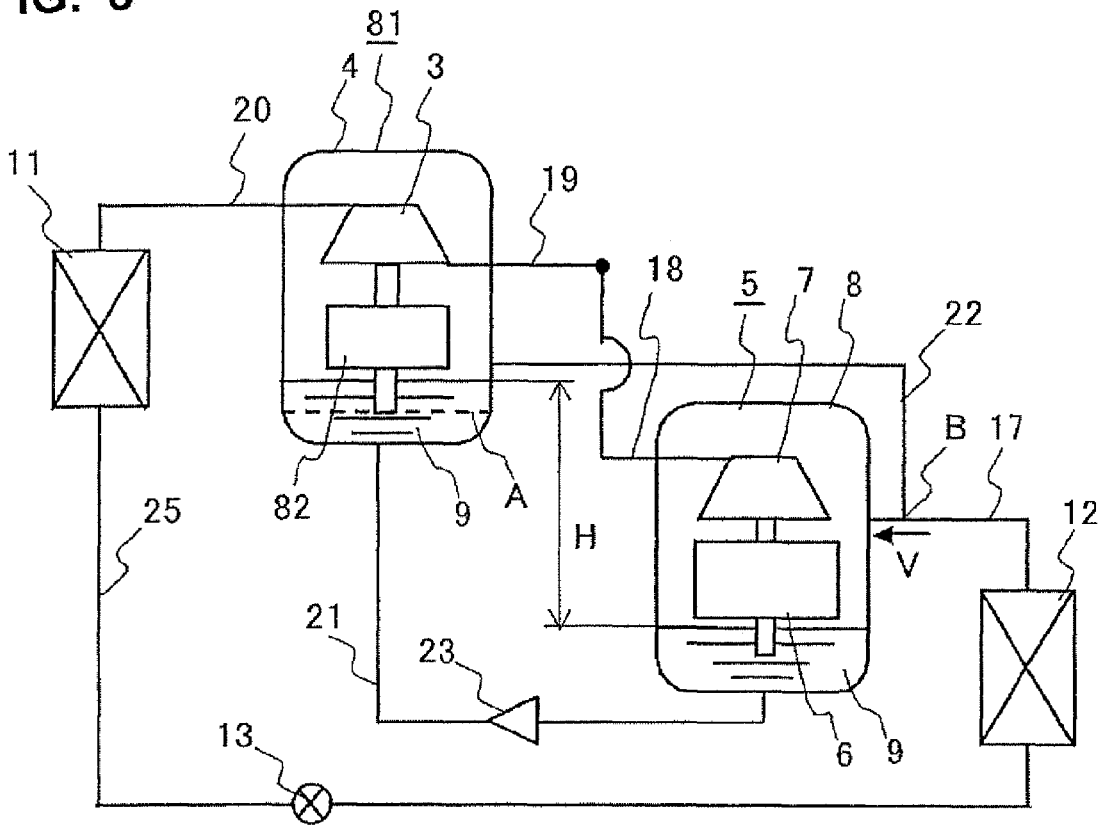
FIG. 8 is a block diagram illustrating the construction of the refrigerating air conditioner according to the embodiment 4 of the present invention.

FIG. 8 is a block diagram illustrating the construction of the refrigerating air conditioner according to the embodiment 4 of the present invention.

In FIG. 8, a sub-compressor 81 comprises the sub-compression mechanism 3 driven by an electric motor mechanism 82 to compress the refrigerant, and the electric motor mechanism 82 and the sub-compression mechanism 3 are housed as one unit within the second hermetic vessel 4 in which the lubricating oil 9 is maintained at the bottom portion thereof. The main compressor 5 comprises the main compression mechanism 7 driven by the electric motor mechanism 6 to compress the refrigerant, and the electric motor mechanism 6 and the main compression mechanism 7 are housed as one unit within the first hermetic vessel 8 in which the lubricating oil 9 is maintained at the bottom portion thereof. As shown in FIG. 8, the installation level of the second hermetic vessel 4 is higher than the installation level of the first hermetic vessel 8.

The sub compression mechanism 3 is disposed on the discharge side of the main compression mechanism 7, and the discharge side of the main compression mechanism 7 and the suction side of the sub-compression mechanism 3 are connected to each other via the main compressor discharge pipe 18 and the sub-compressor suction pipe 19. Also, the discharge side of the sub-compressor 3 and the inlet side of the gas cooler 11 for cooling the refrigerant are connected to each other via the sub-compressor discharge pipe 20. Further, the outlet side of the gas cooler 11 and the inlet side of the evaporator 12 are connected to each other via the gas cooler flow pipe 25. The first expansion valve 13 for expanding the refrigerant is disposed in the gas cooler flow pipe 25. The outlet side of the evaporator 12 and the suction side of the main compression mechanism 7 are connected to each other via the main compressor suction pipe 17 and the first hermetic vessel 8.

Here, since the space within the second hermetic vessel 4 is isolated from the sub-compression mechanism 3, the pressure within the second hermetic vessel 4 is not dependent upon the pressure within the sub-compression mechanism 3. Also, the pressure within the first hermetic vessel 8 is the suction pressure because the main compressor suction pipe 17 is connected to the first hermetic vessel 8.

The bottom portion of the second hermetic vessel 4 and the bottom portion of the first hermetic vessel 8 are connected to each other via the first equalizer pipe 21, and the first equalizer pipe 21 is provided therein with the check valve 23 for preventing the flow of the lubricating oil 9 from the second hermetic vessel 4 to the first hermetic vessel 8. Also, the side of the second hermetic vessel 4 at the position higher than the requisite minimum oil level A and the main compressor suction pipe 17 which is the suction side of the main compression mechanism 7 are connected to each other via the second equalizer pipe 22.

The operation of the refrigerating air conditioner according to embodiment 4 of the present invention will now be described in conjunction with FIG. 8.

When the main compressor mechanism 7 is driven by the electric motor mechanism 6, the refrigerant at low temperature and low pressure and in the gaseous state is suctioned from the main compressor suction pipe 17 into the first hermetic vessel 8. The refrigerant suctioned from the first hermetic vessel 8 to the main compressor mechanism 7 is compressed to an intermediate pressure and discharged through the main compressor discharge pipe 18. The refrigerant at the intermediate pressure introduced into the sub compressor suction pipe 19 from the main compressor discharge pipe 18 is further compressed by the sub compressor mechanism 3 to be high temperature and high pressure and discharged into the sub compressor discharge pipe 20. The refrigerant discharged into the sub compressor discharge pipe 20 dissipates its heat at the gas cooler 11 and flows into the gas cooler flow pipe 25. The refrigerant flown out into the gas cooler flow pipe 25 is expanded at the first expansion valve 13 to become into the vapor-liquid two phase state at low temperature and low pressure state and flows into the evaporator 12. The refrigerant introduced into the evaporator 12 is heated and evaporated and then flows back into the first hermetic vessel 8 via the main compressor suction pipe 17.

Here, the pressure at the suction side of the main compressor mechanism 7 is referred to as a low pressure, the pressure at the discharge side of the sub compression mechanism 3 is referred to as a high pressure, and the pressure at the discharge side of the main compression mechanism 7 which is at the suction side of the sub compression mechanism 3 is referred to as an intermediate pressure.

The behavior of the lubricating oil 9 within the second hermetic vessel 4 and the first hermetic vessel 8 in the above-described operation is similar to that described in relation to the refrigerating air conditioner of embodiment 1 and the oil level in each of the hermetic vessels 4 and 8 is automatically regulated.

As has been described, the refrigeration air conditioner according to embodiment 4 of the present invention comprises the first equalizer pipe 21 connecting the bottom portion of the first hermetic vessel 8 and the bottom portion of the second hermetic vessel 4, and the second equalizer pipe 22 connecting the side of the second hermetic vessel 4 at the position higher than the requisite minimum oil level A and the suction side of the main compression mechanism 7, the inside of the first hermetic vessel 8 being filled with an atmosphere at the suction pressure, the space within the second hermetic vessel 4 is isolated from the sub-compression mechanism, and the pressure within the second hermetic vessel 4 is not dependent upon the pressure within the sub-compression mechanism 3. Therefore, the oil level in the respective hermetic vessels 4 and 8 can be automatically regulated irrespective of the flow speed V of the gaseous refrigerant within the main compressor suction pipe 17, the level difference H between the oil level within the second hermetic vessel 4 and the oil level within the first hermetic vessel 8. Therefore, the decrease of the reliability due to the sticking or abnormal wear of the sliding parts of the main compressor 5 and the expander 1.

In embodiment 4, the description has been made as to the refrigerating air conditioner in which the installation level of the second hermetic vessel 4 is higher than the installation level of the first hermetic vessel 8, but even when the installation level of the second hermetic vessel 4 is lower than the installation level of the first hermetic vessel 8, or even when the installation level of the second hermetic vessel 4 is the same as the installation level of the first hermetic vessel 8, advantageous results similar to those discussed above can be obtained. When the installation level of the second hermetic vessel 4 is lower than the installation level of the first hermetic vessel 8, or the installation level of the second hermetic vessel 4 is the same as the installation level of the first hermetic vessel 8, the check valve 23 is not necessary. When the installation level of the second hermetic vessel 4 is lower than the installation level of the first hermetic vessel 8, the electromagnetic valve 24, which closes when the refrigerating air conditioner is not operated, may be provided in the first equalizer pipe 21, as in the case of embodiment 2. When the refrigerating air conditioner is not operated, the electromagnetic valve 24 prevents the lubricating oil 9 from moving from the first hermetic vessel 8 to the second hermetic vessel 4 through the first equalizer pipe 21.

While embodiment 4 is described in terms of the sub-compression mechanism 3 disposed on the discharge side of the main compression mechanism 7, the sub-compression mechanism 3 may be disposed on the suction side of the main compression mechanism 7 and advantageous results as above discussed can be obtained. Also, the main compression mechanism 7 and the sub-compression mechanism 3 are directly connected in series in embodiment 4, but similar advantageous results can also be obtained when the main compression mechanism 7 and the sub-compression mechanism 3 are connected in parallel.

The invention claimed is:

1. A refrigeration air conditioner comprising:

a main compression mechanism for compressing a refrigerant;

a gas cooler for cooling the refrigerant compressed;

an expansion mechanism for expanding the refrigerant flowing from said gas cooler to recover power;

a sub-compression mechanism disposed on a discharge side or a suction side of said main compression mechanism for compressing the refrigerant using the power recovered by said expansion mechanism;

an evaporator for evaporating the refrigerant expanded at said expansion mechanism;

a first hermetic vessel containing said main compression mechanism and lubricant oil;

a second hermetic vessel containing said expansion mechanism, said sub-compression mechanism, and lubricant oil;

a first equalizer pipe connecting a bottom portion of said first hermetic vessel, at a position lower than a minimum oil level of said first hermetic vessel, to a bottom portion of said second hermetic vessel, at a position lower than a minimum oil level of said second hermetic vessel;

a second equalizer pipe connecting a side of said second hermetic vessel, at a position higher than the minimum oil level of said second hermetic vessel, to a suction side of said main compression mechanism, wherein a space within said second hermetic vessel is isolated from said expansion mechanism and said sub-compression mechanism, and pressure within said second hermetic vessel is independent of pressure within said expansion mechanism and pressure within said sub-compression mechanism.

2. A refrigeration air conditioner comprising:

a main compression mechanism for compressing a refrigerant;

a sub-compression mechanism disposed on a discharge side or a suction side of said main compression mechanism for compressing the refrigerant;

a gas cooler for cooling the refrigerant compressed;

an expansion valve for expanding the refrigerant flowing from said gas cooler;

an evaporator for evaporating the refrigerant expanded at said expansion valve;

a first hermetic vessel containing said main compression mechanism and lubricant oil;

a second hermetic vessel containing said sub-compression mechanism and lubricant oil;

a first equalizer pipe connecting a bottom portion of said first hermetic vessel, at a position lower than a minimum oil level of said first hermetic vessel, to a bottom portion of said second hermetic vessel, at a position lower than a minimum oil level of said second hermetic vessel;

a second equalizer pipe connecting a side of said second hermetic vessel, at a position higher than the minimum oil level of said second hermetic vessel, to a suction side of said main compression mechanism, wherein a space within said second hermetic vessel is isolated from said sub-compression mechanism, and pressure within said second hermetic vessel is independent of pressure within said sub-compression mechanism.

3. The refrigeration air conditioner as claimed in claim 1, wherein said second hermetic vessel is positioned at a position higher than said first hermetic vessel, and said first equalizer pipe includes a check valve.

4. The refrigeration air conditioner as claimed in claim 1, wherein said second hermetic vessel is positioned at a position lower than said first hermetic vessel, and said first equalizer pipe includes an electromagnetic valve.

5. The refrigeration air conditioner as claimed in claim 1, wherein said expansion mechanism comprises a first orbiting scroll and a first fixed scroll;

said sub-compression mechanism comprises a second orbiting scroll and a second fixed scroll; and said refrigeration air conditioner further comprises seal members disposed at an inner circumference portion and an outer circumference portion of one of said first orbiting scroll and said first fixed scroll and at an inner circumference portion and an outer circumference portion of one of said second orbiting scroll and said second fixed scroll.

6. The refrigeration air conditioner as claimed in claim 2, wherein said second hermetic vessel is positioned at a position higher than said first hermetic vessel, and said first equalizer pipe includes a check valve.

7. The refrigeration air conditioner as claimed in claim 2, wherein said second hermetic vessel is positioned at a position lower than said first hermetic vessel, and said first equalizer pipe includes an electromagnetic valve.

8. A refrigeration air conditioner comprising:

a main compression mechanism for compressing a refrigerant;

a gas cooler for cooling the refrigerant compressed;

an expansion mechanism for expanding the refrigerant flowing from said gas cooler to recover power;

a sub-compression mechanism disposed on a discharge side of said main compression mechanism for compressing the refrigerant using the power recovered by said expansion mechanism;

an evaporator for evaporating the refrigerant expanded at said expansion mechanism;

a first hermetic vessel containing said main compression mechanism and lubricant oil;

a second hermetic vessel containing said expansion mechanism, said sub-compression mechanism, and lubricant oil;

a main compressor suction pipe connecting the first hermetic vessel to an outlet side of the evaporator;

a first equalizer pipe connecting a bottom portion of said first hermetic vessel, at a position lower than a minimum oil level of said first hermetic vessel, to a bottom portion of said second hermetic vessel, at a position lower than a minimum oil level of said second hermetic vessel;

a second equalizer pipe connecting a side of said second hermetic vessel, at a position higher than the minimum oil level of said second hermetic vessel, to said main compression suction pipe;

a first pipe connecting a discharge side of said main compression mechanism to a suction side of said sub-compression mechanism;

a second pipe connecting a discharge side of said sub-compression mechanism to an inlet side of said gas cooler;

a third pipe connecting an outlet side of said gas cooler to a suction side of said expansion mechanism; and a fourth pipe connecting an outlet side of said expansion mechanism to an inlet side of said evaporator, wherein a space within said second hermetic vessel is isolated from said expansion mechanism and said sub-compression mechanism, and pressure within said second hermetic vessel is independent of pressure within said expansion mechanism and pressure within said sub-compression mechanism.

9. A refrigeration air conditioner comprising:

a main compression mechanism for compressing a refrigerant;

a gas cooler for cooling the refrigerant compressed;

an expansion mechanism for expanding the refrigerant flowing from said gas cooler to recover power;

a sub-compression mechanism disposed on a discharge side of said main compression mechanism for compressing the refrigerant using the power recovered by said expansion mechanism;

an evaporator for evaporating the refrigerant expanded at said expansion mechanism;

a first hermetic vessel containing said main compression mechanism and lubricant oil;

a second hermetic vessel containing said expansion mechanism, said sub-compression mechanism, and lubricant oil;

a main compressor suction pipe connecting the first hermetic vessel to an outlet side of the evaporator;

a first equalizer pipe connecting a bottom portion of said first hermetic vessel, at a position lower than a minimum oil level of said first hermetic vessel, to a bottom portion of said second hermetic vessel, at a position lower than a minimum oil level of said second hermetic vessel;

a second equalizer pipe connecting a side of said second hermetic vessel, at a position higher than the minimum oil level of said second hermetic vessel, to said main compression suction pipe;

a first pipe connecting an outlet side of said evaporator and the suction side of said sub-compression mechanism;

a second pipe connecting an outlet side of said gas cooler and a suction side of said expansion mechanism; and a third pipe connecting an outlet side of said expansion mechanism to an inlet side of said evaporator, wherein a space within said second hermetic vessel is isolated from said expansion mechanism and said sub-compression mechanism, and pressure within said second hermetic vessel is independent of pressure within said expansion mechanism and pressure within said sub-compression mechanism.

10. A refrigeration air conditioner comprising:

a main compression mechanism for compressing a refrigerant;

a sub-compression mechanism disposed on a discharge side or a suction side of said main compression mechanism for compressing the refrigerant;

a gas cooler for cooling the refrigerant compressed;

an expansion valve for expanding the refrigerant flowing from said gas cooler;

an evaporator for evaporating the refrigerant expanded at said expansion valve;

a first hermetic vessel containing said main compression mechanism and lubricant oil;

a second hermetic vessel containing said sub-compression mechanism and lubricant oil;

a main compressor suction pipe connecting said first hermetic vessel to an outlet side of said evaporator;

a first equalizer pipe connecting a bottom portion of said first hermetic vessel, at a position lower than a minimum oil level of said first hermetic vessel, to a bottom portion of said second hermetic vessel, at a position lower than a minimum oil level of said second hermetic vessel;

a second equalizer pipe connecting a side of said second hermetic vessel, at a position higher than the minimum oil level of said second hermetic vessel, to a suction side of said main compression mechanism;

a first pipe connecting a discharge side of said main compression mechanism to a suction side of said sub-compression mechanism; and a second pipe connecting a discharge side of said sub-compression mechanism and an inlet side of said gas cooler, wherein a space within said second hermetic vessel is isolated from said sub-compression mechanism, and pressure within said second hermetic vessel is independent of pressure within said sub-compression mechanism.

11. A refrigeration air conditioner comprising:

a main compression mechanism for compressing a refrigerant;

a sub-compression mechanism disposed on a discharge side or a suction side of said main compression mechanism for compressing the refrigerant;

a gas cooler for cooling the refrigerant compressed;

an expansion valve for expanding the refrigerant flowing from said gas cooler;

an evaporator for evaporating the refrigerant expanded at said expansion valve;

a first hermetic vessel containing said main compression mechanism and lubricant oil;

a second hermetic vessel containing said sub-compression mechanism and lubricant oil;

a main compressor suction pipe connecting said first hermetic vessel to a discharge side of said sub-compression mechanism;

a first equalizer pipe connecting a bottom portion of said first hermetic vessel, at a position lower than a minimum oil level of said first hermetic vessel, to a bottom portion of said second hermetic vessel, at a position lower than a minimum oil level of said second hermetic vessel;

a second equalizer pipe connecting a side of said second hermetic vessel, at a position higher than the minimum oil level of said second hermetic vessel, to a suction side of said main compression mechanism;

a first pipe connecting a suction side of said sub-compression mechanism to an outlet side of said evaporator, wherein a space within said second hermetic vessel is isolated from said sub-compression mechanism, and pressure within said second hermetic vessel is independent of pressure within said sub-compression mechanism.

* * * * *